US007536997B2

(12) United States Patent
Koehler et al.

(10) Patent No.: US 7,536,997 B2
(45) Date of Patent: May 26, 2009

(54) TWO-POINT CONTROL OF A HIGH-PRESSURE PUMP FOR DIRECT-INJECTING GASOLINE ENGINES

(75) Inventors: Christian Koehler, Erligheim (DE); Ruediger Schnell, Eberbach (DE); Timm Hollmann, Ludwigsburg (DE); Yves Lamirand, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 273 days.

(21) Appl. No.: 10/593,593

(22) PCT Filed: Feb. 24, 2006

(86) PCT No.: PCT/EP2006/060251

§ 371 (c)(1),
(2), (4) Date: Oct. 5, 2006

(87) PCT Pub. No.: WO2006/103147

PCT Pub. Date: Oct. 5, 2006

(65) Prior Publication Data

US 2008/0234916 A1 Sep. 25, 2008

(30) Foreign Application Priority Data

Mar. 29, 2005 (DE) ..... 10 2005 014 093

(51) Int. Cl.
*F02M 37/04* (2006.01)

(52) U.S. Cl. ..... 123/495; 123/500

(58) Field of Classification Search ..... 123/41.31, 123/500, 501, 506, 458, 495, 496
See application file for complete search history.

(56) References Cited

U.S. PATENT DOCUMENTS

| | | | | |
|---|---|---|---|---|
| 4,082,072 | A * | 4/1978 | Johnson | 123/495 |
| 4,376,432 | A * | 3/1983 | Davis | 123/450 |
| 5,560,326 | A * | 10/1996 | Merritt | 123/51 AA |
| 6,237,573 | B1 | 5/2001 | Onishi et al. | |
| 7,387,109 | B2 * | 6/2008 | Rembold et al. | 123/446 |

FOREIGN PATENT DOCUMENTS

| | | |
|---|---|---|
| EP | 0 802 322 | 10/1997 |
| EP | 1 327 766 | 11/2002 |

* cited by examiner

*Primary Examiner*—John T Kwon
(74) *Attorney, Agent, or Firm*—Michael J. Striker

(57) ABSTRACT

In a method for operating an internal combustion engine (10) equipped with a piston pump as a high-pressure pump (18), which is driven by a drive shaft (28) of the engine (10), in which the high-pressure pump (18) delivers fuel from a low-pressure region (16) to a high-pressure side (38) and a quantity control valve (44) sets the quantity of fuel delivered by the high-pressure pump (18), the acoustic emission of the high-pressure pump is reduced by virtue of the fact that the high-pressure pump (18) functions in a two-point operation, alternating between full delivery for individual or successive piston strokes and idle delivery for individual or successive piston strokes and, when the pressure falls below a lower pressure threshold, the full delivery is activated until an upper pressure threshold is reached.

10 Claims, 3 Drawing Sheets

TWO-POINT CONTROL OF A HIGH-PRESSURE PUMP FOR DIRECT-INJECTING GASOLINE ENGINES

CROSS REFERENCE TO RELATED APPLICATIONS

This application claims priority under 35 U.S.C. 119(a)-(d) to German Patent Application DE 102005014093.3, filed Mar. 29, 2005.

BACKGROUND OF THE INVENTION

1. Field of the Invention

The present invention relates to a method for operating an internal combustion engine equipped with a piston pump as a high-pressure pump, which is driven by a drive shaft of the engine; the high-pressure pump delivers fuel from a low-pressure region to a high-pressure side and a quantity control valve sets the quantity of fuel delivered by the high-pressure pump.

2. Related Art

In direct-injection gasoline engines (GDI=gasoline direction injection), one-cylinder high-pressure pumps are used to raise the pressure from the preliminary pressure of the pre-supply pump (EFP=electric fuel pump) to the pressure required for the direct injection (50 to 200 bar). These one-cylinder pumps are operated with 2, 3, or 4 pump strokes per camshaft rotation, depending on the amount of fuel that the motor requires. Usually, the driving action is provided by a cam on the camshaft. During normal operation, each pump stroke is used and the required quantity is set, for example, by a quantity control valve. In other words, when operating in idle mode and in the partial load range, only part of the possible quantity per pump stroke is delivered.

EP-1327766-A2 has disclosed a method in which only a part of the delivery strokes is used at low supply quantities. The motivation for this is the better controllability at very low supply quantities. In this method, a fixed pattern of used and unused delivery strokes in relation to the camshaft rotation is set, e.g. only 2 out of 4 delivery strokes are used.

3. Problems of the Prior Art

When in delivery mode, the high-pressure pump generates structure-borne acoustic vibrations, which generate airborne sound that is perceived as acoustic noise. The method is intended to reduce the acoustic emission of the high-pressure pump and to change this acoustic emission so that it is not perceived as annoying.

BRIEF SUMMARY OF THE INVENTION

This problem is solved by a method for operating an internal combustion engine equipped with a piston pump as a high-pressure pump, which is driven by a drive shaft of the engine; the high-pressure pump delivers fuel from a low-pressure region to a high-pressure side and a quantity control valve sets the quantity of fuel delivered by the high-pressure pump; the high-pressure pump functions in a two-point operation, alternating between full delivery for individual or successive piston strokes and idle delivery for individual or successive piston strokes and, when the pressure falls below a lower pressure threshold, the full delivery is activated until an upper pressure threshold is reached.

The term "full delivery" is understood to mean that the high-pressure pump delivers the maximum quantity, i.e. the quantity control valve remains closed during the entire piston stroke. The term "idle delivery" is understood to mean the exact opposite: the high-pressure pump does not deliver any fuel over the entire piston stroke, i.e. the quantity control valve remains continuously open. The term "partial delivery" is understood to mean a delivery quantity between idle delivery and full delivery; in this case, the quantity control valve is opened intermittently during the piston stroke of the piston pump so that a delivery quantity of between zero and the maximum delivery quantity can be achieved. The upper pressure threshold and the lower pressure threshold depend on the pressure in the accumulator required to reliably execute an injection. The two pressure thresholds can be identical and correspond to the desired pressure of the high-pressure side or can be slightly higher and lower, respectively, than the desired pressure.

An essential aspect of this method is to limit the frequency of delivery by the high-pressure pump to the absolute amount required. This is achieved by switching to two-point control in idle mode and executing each activated delivery with the maximum delivery quantity. This brings to bear the effect that a full delivery of the high-pressure pump is quieter than a partial delivery. The two effects cause the acoustic emission of this control method to be significantly lower than that of the method currently in use.

Preferably, the two-point operation is activated when the engine speed falls below a minimum speed and/or when the injection quantity falls below a minimum quantity. The decrease to below a minimum speed can, for example, be when the idling speed is reached. In one embodiment of the method, when not in idle mode, the high-pressure pump is operated with partial delivery.

The term "idle mode" here is defined on the one hand by a speed range typical of internal combustion engines and on the other hand by the speed requested by the driver during operation, for example when the gas pedal of an automobile is brought into the idle position. Other requests of the operator that signal idle mode as the requested engine speed include, for example, when the selector lever is moved into the park position in an automatic transmission or in an automated manual transmission.

In another embodiment of the method, after the upper pressure limit is reached, the high-pressure pump is switched to idle delivery until the pressure falls back below the lower pressure limit. The high-pressure pump is operated in the full delivery mode when the quantity control valve is closed and is operated in the partial delivery mode when the quantity control valve is intermittently or continuously open. The quantity control valve remains open down to a lower pressure threshold and, once the lower pressure threshold has been reached, remains closed until the upper pressure threshold is reached.

In another embodiment of the method, the quantity control valve is opened when the upper the pressure threshold is reached.

The problem mentioned at the beginning is also solved by an internal combustion engine equipped with a piston pump as a high-pressure pump, which is driven by a drive shaft of the engine; the high-pressure pump delivers fuel from a low-pressure region to a high-pressure side and a quantity control valve sets the quantity of fuel that the high-pressure pump delivers to the accumulator, characterized in that in idle mode, the high-pressure pump can be operated in full delivery mode and in idle delivery mode.

The problem mentioned at the beginning is also solved by a control unit for an internal combustion engine, characterized in that it is able to execute a method as described herein.

The problem mentioned at the beginning is also solved by a piece of software for a stored program control unit for an internal combustion engine, characterized in that it is able to execute a method as described herein.

BRIEF DESCRIPTION OF THE DRAWINGS

An exemplary embodiment of the present invention will be explained in detail below in conjunction with the accompanying drawings.

DETAILED DESCRIPTION OF THE INVENTION

Figure 1:
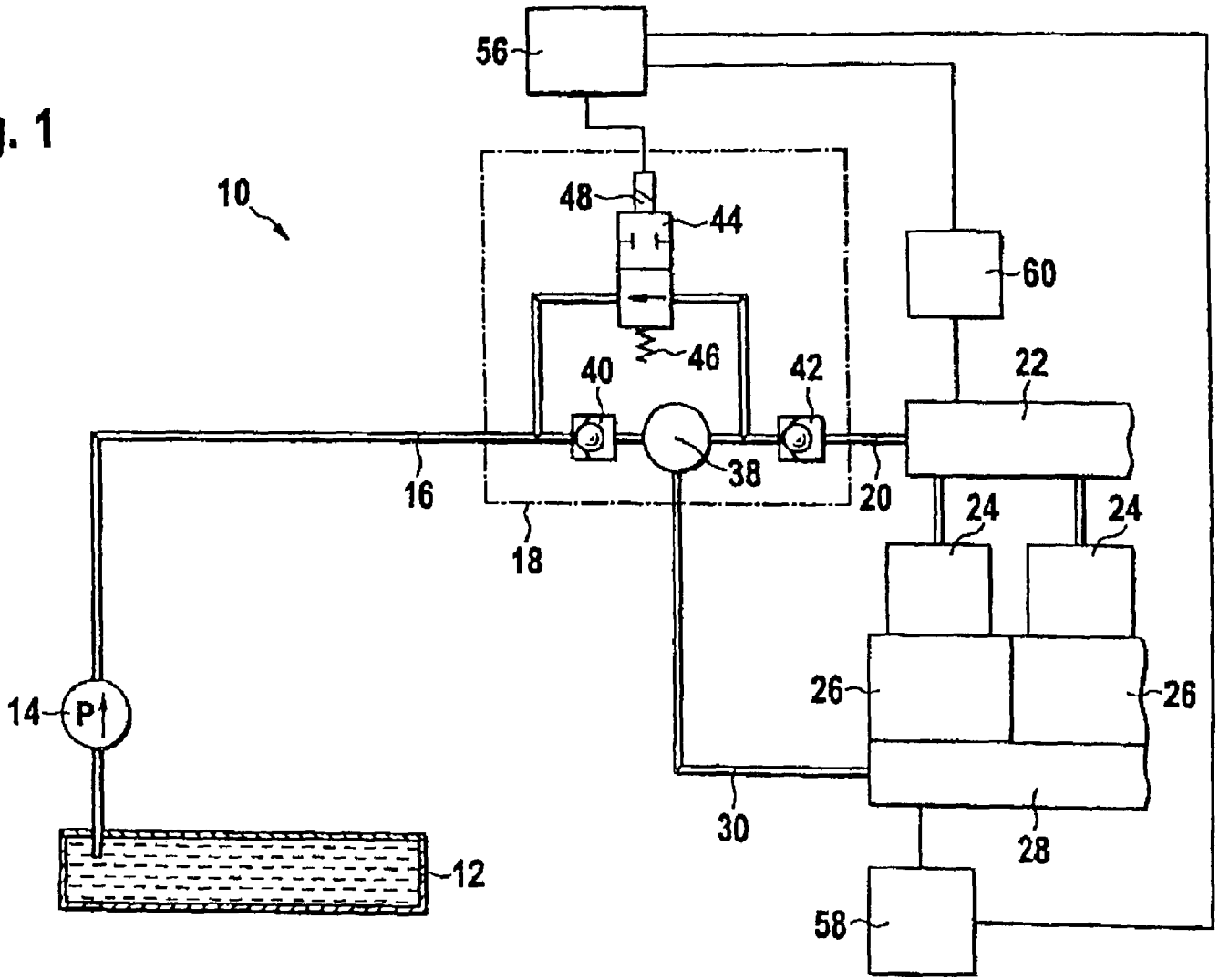
FIG. 1 is a schematic depiction of an internal combustion engine equipped with a fuel pump and a quantity control valve.
Figure 4:
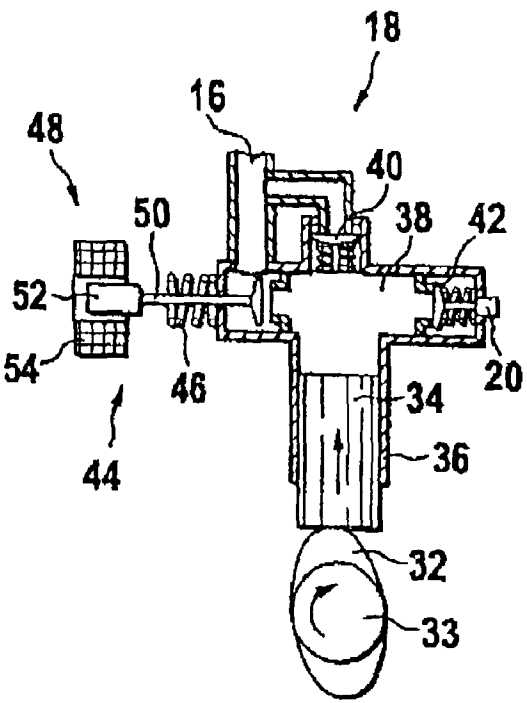
FIG. 4 is a depiction similar to FIG. 2 toward the end of a delivery stroke.
Figure 3:
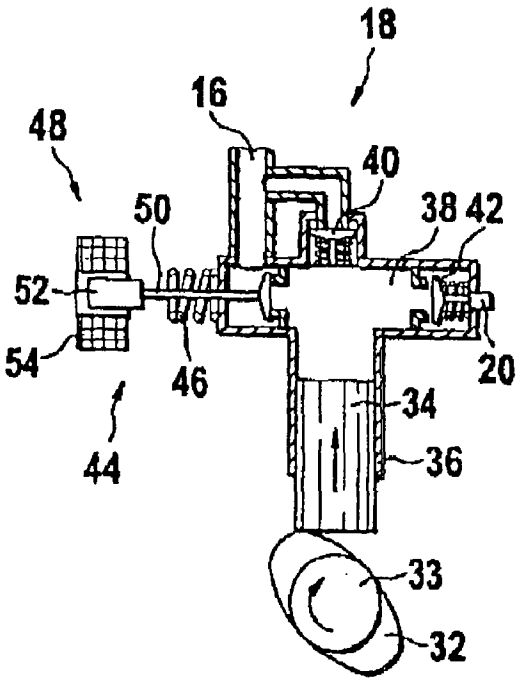
FIG. 3 is a depiction similar to FIG. 2 at the beginning of a delivery stroke.
Figure 2:
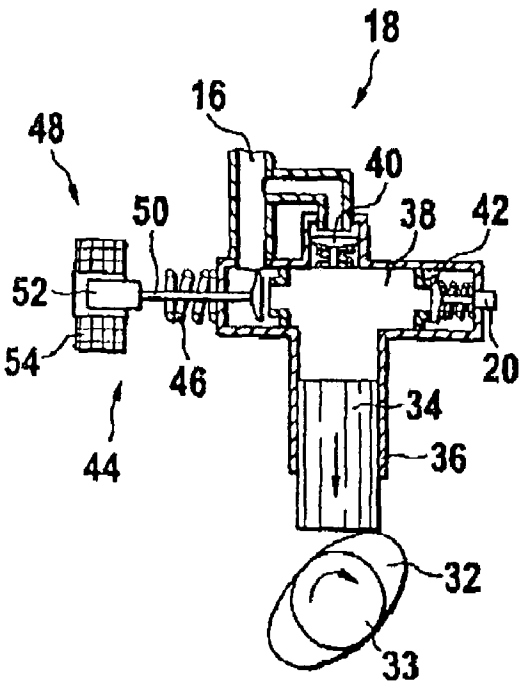
FIG. 2 is a detailed depiction of the fuel pump and the quantity control valve from FIG. 1 during an intake stroke.

An internal combustion engine 10 according to FIG. 1—this can in particular be a direct-injecting gasoline engine—includes a fuel tank 12 from which an electrically driven prefeed pump 14 delivers fuel via a low-pressure line 16 to a high-pressure pump 18. The fuel travels onward via a high-pressure line 20 to an accumulator 22 (also referred to as the common rail) in which the fuel is stored at high pressure. The accumulator 22 has a number of injection devices 24 connected to it that inject the fuel directly into combustion chambers 26. The combustion of the fuel in the combustion chambers 26 sets a crankshaft 28 into rotation. Via a mechanical coupling 30 that is only depicted schematically in FIG. 1, the high-pressure pump 13 is driven by the crankshaft 28 serving as a drive shaft. The high-pressure pump 18 is a one-cylinder piston pump in which a drive cam 32 on a shaft 33 sets a piston 34 into a reciprocating motion. The piston 34 is guided in a housing 36 and delimits a delivery chamber 38. An inlet valve 40 can connect the delivery chamber 38 to the low-pressure fuel line 16. The inlet valve 40 is embodied in the form of a spring-loaded check valve. An outlet valve 42 can connect the delivery chamber 38 to the high-pressure line 20. The outlet valve 42 is also a spring-loaded check valve. A quantity control valve 44 can also connect the delivery chamber 38 to the low-pressure chamber 16. The quantity control valve 44 is a 2/2-way switching valve. A spring 46 brings it into the open, neutral position. An electromagnetic actuating device 48 brings it into the closed, switched position. This actuating device includes a magnetic armature 52 that is connected to a valve element 50 and is encompassed by a magnetic coil 54. The magnetic coil 54 is supplied with current by the driver stage, not shown, of a control unit 56. The control unit 56 receives signals from a speed sensor 58, which senses the speed of the crankshaft 23 of the internal combustion engine 10. The input side of the control unit 56 is also connected to a pressure sensor 60 that detects the pressure prevailing in the accumulator 22 and transmits corresponding signals to the control unit 56. The principal of adjusting the fuel quantity delivered by the high-pressure pump 18 will now be explained in conjunction with FIGS. 2 through 4. During the intake stroke depicted in FIG. 2, the piston 34 moves downward so that fuel flows into the delivery chamber 38 via the inlet valve 40. After reaching the bottom dead center, the piston 34 moves upward again (FIG. 3). During the intake stroke of the piston 34, the magnetic coil 54 of the quantity control valve 44 is supplied with current so that, at the very latest, this valve closes when the piston 34 reaches the bottom dead center. The inlet valve 40 also closes. During the delivery stroke of the piston 34, if the pressure in the delivery chamber 38 exceeds the opening pressure of the outlet valve 42, then the outlet valve opens. The fuel can thus be pushed into the accumulator 22. If the delivery of fuel into the accumulator 22 must be terminated during the delivery stroke of the piston 34, then the supply of current to the magnetic coil 54 of the quantity control valve 44 is disconnected so that the quantity control valve switches back into the neutral position. This is shown in FIG. 4. The fuel can thus escape from the delivery chamber 38 into the low-pressure line 16 via the open quantity control valve 44. Correspondingly, the outlet valve 42 also closes. The maximum fuel quantity that can be delivered during a delivery stroke of the piston 34 is essentially independent of the speed of the crankshaft 28 and the related duration of a delivery stroke. During each $ci^{th}$ delivery stroke, the quantity control valve 44 can close off the delivery chamber 38 from the low-pressure line 16 for a certain duration.

When not in idle mode, the quantity control valve 44 is actuated so that each delivery stroke of the pump is used. The quantity is controlled by using partial strokes through intermittent opening of the quantity control valve 44, as described above. In idle mode, however, the operation switches over to a two-point control with full delivery. This means that a delivery and therefore the actuation of the quantity control valve 44 is only triggered if the pressure falls below a pressure threshold on the high-pressure side. In this operating state, the delivery is always executed as a full delivery so that the pressure in the high-pressure system increases by a relatively large amount. The injections that follow cause the pressure to decrease again steadily. But since the injection quantities are low in idle mode, it takes a relatively long time before the pressure falls below the lower pressure threshold that triggers the next delivery.

Figure 5:
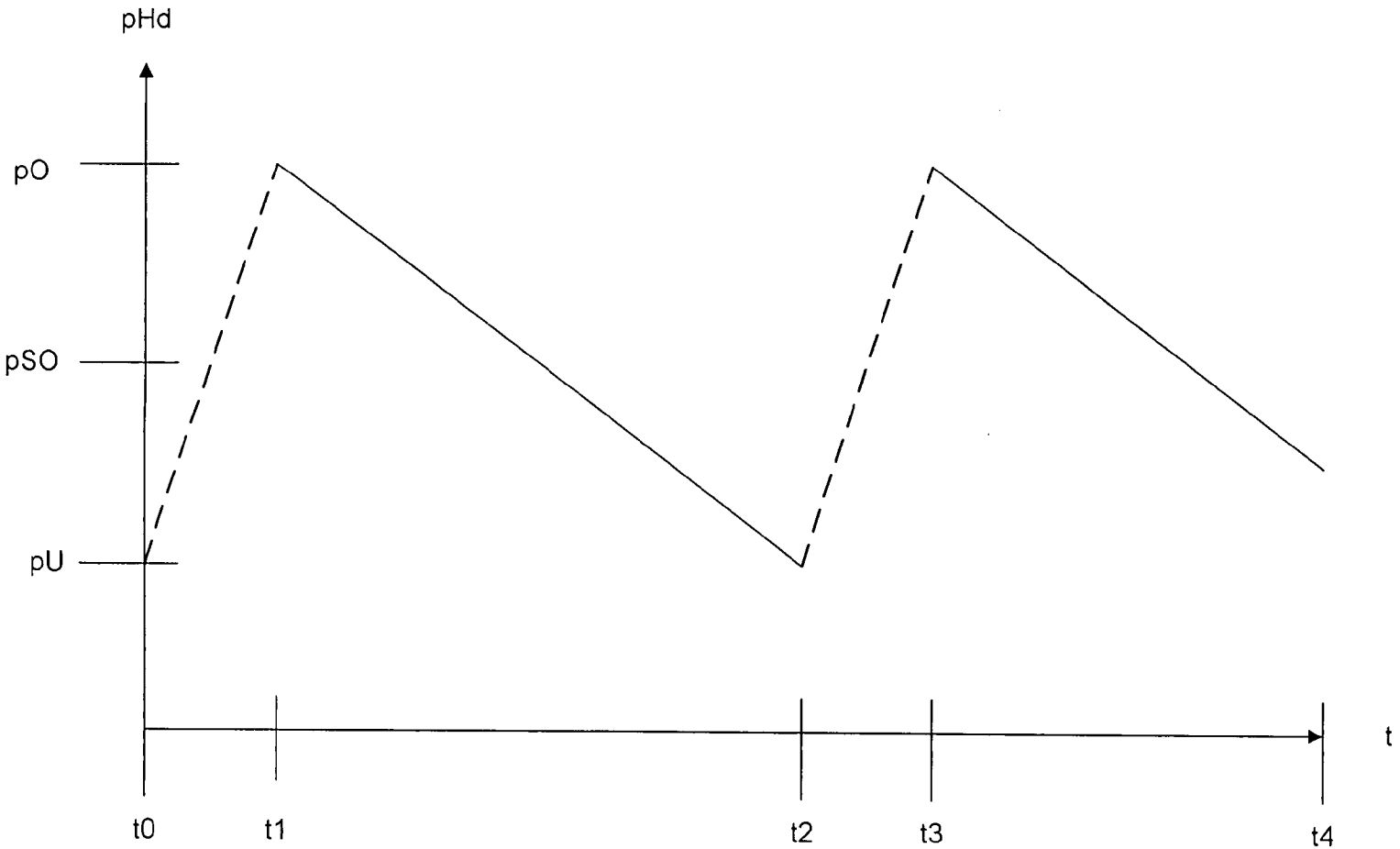
FIG. 5 is a graph of the curve of the process over time.

FIG. 5 is a graph of the curve of the process over time. The pressure pHd in the accumulator 22, i.e. the pressure in the common rail, is plotted over time t. The pressure curve is shown between an arbitrarily selected time t0 and an arbitrarily selected time t4. At time t0, the pressure pHd should equal the value of a lower pressure threshold pU. At this time, the quantity control valve 44 is closed so that the high-pressure pump delivers for the entire piston stroke and is operated in an operating mode that is referred to below as a full delivery. The quantity control valve 44 remains closed until an upper pressure threshold pO is reached; this occurs at time t1. At time t1, the quantity control valve 44 is completely open so that the high-pressure pump 18 no longer delivers any fuel to the high-pressure side. This operating mode is referred to below as idle delivery. Because the injection devices 24 continue to execute injections, the pressure pHd in the accumulator 22 (common rail) decreases with each injection. For the sake of simplicity, this is depicted as a continuous line in FIG. 5, but in reality, this is not continuous, but is instead more or less step-like in the depiction over time. At time t2, the lower pressure threshold pU is reached again so that the closing of the quantity control valve 44 switches the high-pressure pump 18 back into the full delivery operating mode. When the upper pressure threshold pO is reached at time t3, the high-pressure pump 18 is switched back into the idle delivery mode so that the pressure pHd falls again. In the time spans t0 to t1 and t2 to t3, one or more piston strokes are executed, depending on the maximum delivery quantity of the high-pressure pump 18. The duration of the idle delivery mode, i.e. between times t1 and t2, essentially depends on the storage capacity of the accumulator 22 and the respective quantity injected. The operating mode depicted in FIG. 5 is only selected in the idle mode of the internal combustion engine. When not in idle mode, the high-pressure pump 18 is operated in a partial delivery operating mode. In this operating mode, fuel is delivered to the high-pressure side with each piston stroke of the fuel pump 18. The quantity control valve 44 controls the fuel quantity by intermittently opening as needed (e.g. partial load) during the piston stroke of the fuel pump 18. FIG. 5 also shows a desired pressure Pso, to which the rail pressure (on the high-pressure side) should be set in the respective operating range. The lower pressure threshold pU and upper pressure threshold pO are close to the desired pressure. The activation condition for the above-explained two-point control can be selected, for example, to be when the engine speed falls below a minimum speed (e.g. when it reaches the idling speed) or when the injection quantity falls below a minimum quantity. In this connection, the Lambda regulation should be active, the engine temperature should be within a permissible range (normal temperature), and the engine should have been started long enough ago for the starting oscillations to have reached a steady state.

What is claimed is:

1. A method for operating an internal combustion engine (10) equipped with a piston pump as a high-pressure pump (18), which is driven by a drive shaft (28) of the engine (10); the high-pressure pump (18) delivers fuel from a low-pressure region (16) to a high-pressure side (38) and a quantity control valve (44) sets the quantity of fuel delivered by the high-pressure pump (18), wherein the high-pressure pump (18) functions in a two-point operation, alternating between full delivery for one of individual and successive piston strokes and idle delivery for individual or successive piston strokes and, when the pressure falls below a lower pressure threshold, the full delivery is activated until an upper pressure threshold is reached.

2. The method as recited in claim 1, wherein the two-point operation is activated when one of the engine speed falls below a minimum speed and the injection quantity falls below a minimum quantity.

3. The method as recited in claim 1, wherein above the minimum speed, the high-pressure pump (18) is operated with partial delivery.

4. The method as recited in claim 1, wherein after the upper pressure threshold has been reached, the high-pressure pump (18) is switched into idle delivery mode until the pressure falls below the lower pressure threshold again.

5. The method as recited in claim 1, wherein the high-pressure pump (18) is operated in full delivery mode when the quantity control valve (44) is closed and is operated in the partial delivery mode when the quantity control valve (44) is intermittently or continuously open.

6. The method as recited in claim 1, wherein the quantity control valve (44) remains open down to a lower pressure threshold and then, when the lower pressure threshold has been reached, is closed until an upper threshold is reached.

7. The method as recited in claim 1, wherein the quantity control valve (44) is opened when the upper pressure threshold is reached.

8. An internal combustion engine (10) equipped with a piston pump as a high-pressure pump (18), which is driven by a drive shaft (28) of the engine (10); the high-pressure pump (18) delivers fuel from a low-pressure region (16) to a high-pressure side (38) and a quantity control valve (44) sets the quantity of fuel delivered by the high-pressure pump (18), wherein the high-pressure pump (18) functions in a two-point operation, alternating between full delivery for one of individual and successive piston strokes and idle delivery for individual or successive piston strokes and, when the pressure falls below a lower pressure threshold, the full delivery is activated until an upper pressure threshold is reached.

9. A control unit for an internal combustion engine, wherein the internal combustion engine (10) is equipped with a piston pump as a high-pressure pump (18), which is driven by a drive shaft (28) of the engine (10); the high-pressure pump (18) delivers fuel from a low-pressure region (16) to a high-pressure side (38) and a quantity control valve (44) sets the guantity of fuel delivered by the high-pressure pump (18), wherein the high-pressure pump (18) functions in a two-point operation, alternating between full delivery for one of individual and successive piston strokes and idle delivery for individual or successive piston strokes and, when the pressure falls below a lower pressure threshold, the control unit activates full delivery until an upper pressure threshold is reached.

10. A piece of software for a stored program control unit for an internal combustion engine, wherein the software is able to execute a method for operating an internal combustion engine (10) eguipped with a piston pump as a high-pressure pump (18), which is driven by a drive shaft (28) of the engine (10); the high-pressure pump (18) delivers fuel from a low-pressure region (16) to a high-pressure side (38) and a guantity control valve (44) sets the quantity of fuel delivered by the high-pressure pump (18), wherein the high-pressure pump (18) functions in a two-point operation, alternating between full delivery for one of individual and successive piston strokes and idle delivery for individual or successive piston strokes and, when the pressure falls below a lower pressure threshold, the full delivery is activated until an upper pressure threshold is reached.

* * * * *